US005366021A

United States Patent [19]

Coleman

[11] Patent Number: 5,366,021

[45] Date of Patent: Nov. 22, 1994

[54] FIRE FIGHTING EQUIPMENT FOR USE IN ASSOCIATION WITH HOMES EQUIPPED WITH SWIMMING POOLS

[75] Inventor: Lynn Coleman, Scottsdale, Ariz.

[73] Assignee: Aquapad USA, Inc., Huntington Beach, Calif.

[21] Appl. No.: 52,367

[22] Filed: Apr. 23, 1993

[51] Int. Cl.[5] ..... A62C 35/68

[52] U.S. Cl. ..... 169/16; 169/13; 210/169; 210/424

[58] Field of Search ..... 169/13, 16, 18; 210/169, 424

[56] References Cited

U.S. PATENT DOCUMENTS

| | | | |
|---|---|---|---|
| 3,179,181 | 4/1965 | Banzato | 169/13 |
| 4,330,040 | 5/1982 | Ence et al. | 169/13 |
| 4,428,434 | 1/1984 | Gelaude | 169/13 |
| 4,601,307 | 7/1986 | Johnson | 137/246.22 |
| 4,836,290 | 6/1989 | Le Lande, Jr. | 169/13 X |
| 4,991,657 | 2/1991 | Le Lande, Jr. | 169/13 X |
| 5,125,458 | 6/1992 | Berman | 169/13 X |

FOREIGN PATENT DOCUMENTS

| | | | |
|---|---|---|---|
| 2603194 | 3/1988 | France | 169/13 |
| 2672222 | 8/1992 | France | 169/13 |

*Primary Examiner*—David M. Mitchell
*Assistant Examiner*—Andrew C. Pike
*Attorney, Agent, or Firm*—Klein & Szekeres

[57] ABSTRACT

Fire fighting equipment is adapted for installation in association with a swimming pool or spa and associated water filtering and circulating equipment. A three-way valve is fluidly connected to a pipe which delivers water to a swimming pool filter under the pressure of a pump normally used for circulating water in the conventional swimming pool installation. The three-way valve or equivalent valve system, normally delivers the water to the filter from where it is recirculated into the swimming pool or spa. The three-way valve, or equivalent valve system, is capable of optionally diverting a substantial amount of the water, under the pressure of the pump, into a fire hose which is fluidly connected to the three-way valve. The fire hose, with a suitable hose attached to one end thereof, is thus capable of fighting a fire in the proximity of the swimming pool by using the available water and pump normally associated with the swimming pool.

15 Claims, 4 Drawing Sheets

FIRE FIGHTING EQUIPMENT FOR USE IN ASSOCIATION WITH HOMES EQUIPPED WITH SWIMMING POOLS

BACKGROUND OF THE INVENTION

1. Field of the Invention

The present invention is in the field of fire prevention devices. More particularly, the present invention is directed to a device which can be added to existing swimming pool or spa installations in homes and other buildings to utilize the water supply available in the swimming pool or spa and the pump which is associated with the pool or spa, to provide a supply of high pressure water suitable for fighting fires in an emergency.

2. Brief Description of the Prior Art

Fire hoses connected to municipal water supply have been known for a long time. Various types of valves and equipment for operating a swimming pool of the type ordinarily associated with homes, are also old in the art. It has also been a practice in the prior art for firemen to drop an intake pipe (or the like) into a swimming pool and to use a motor driven pump to drive water under high pressure into a fire hose, in situations where there is a fire in proximity to a swimming pool or like water reservoir, and where alternative and better supply of water is not readily available. To the best knowledge of the present inventor the prior art has not provided permanently installed equipment which is integrated with a swimming pool or spa of the type normally associated with homes or like buildings, and which utilizes the supply of water in the pool and the pump normally used for circulating and filtering pool water, for providing a stream of high pressure water for fighting fires in an emergency. The present invention provides such equipment.

SUMMARY OF THE INVENTION

It is an object of the present invention to provide equipment which an occupant of a home or like building can use for fighting a fire in an emergency with the water available from a swimming pool or spa of the type normally associated with a home or like building.

It is another object of the present invention to provide equipment which meets the foregoing objective and which utilizes a pump normally associated with the pool or spa for circulating the water in the pool.

It is still another object of the present invention to provide equipment which meets the foregoing objectives and which is available in a kit form for relatively easy installation with an existing home swimming pool or spa system.

The foregoing objects and advantages are attained by equipment which includes a three-way valve (or equivalent valve system), a fire hose, and a nozzle. The three-way valve is fluidly connected to a pipe which delivers water to a swimming pool filter under the pressure of a pump normally used for circulating water in a conventional swimming pool installation. The three-way valve, or equivalent valve system, normally delivers the water to the filter from where it is reintroduced into the swimming pool or spa. The three-way valve, or equivalent valve system, is also capable of optionally diverting a substantial amount of the water, under the pressure of the pump, into the fire hose which is fluidly connected to the three-way valve. The fire hose, with a suitable nozzle attached to one end thereof, is thus capable of fighting a fire in the proximity of the swimming pool by using the available water and pump normally associated with the swimming pool. Of course the water provided by the pump can also be put to some use other than fighting a fire.

The features of the present invention can be best understood together with further objects and advantages by reference to the following description, taken in connection with the accompanying drawings, wherein like numerals indicate like parts.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Figure 1:
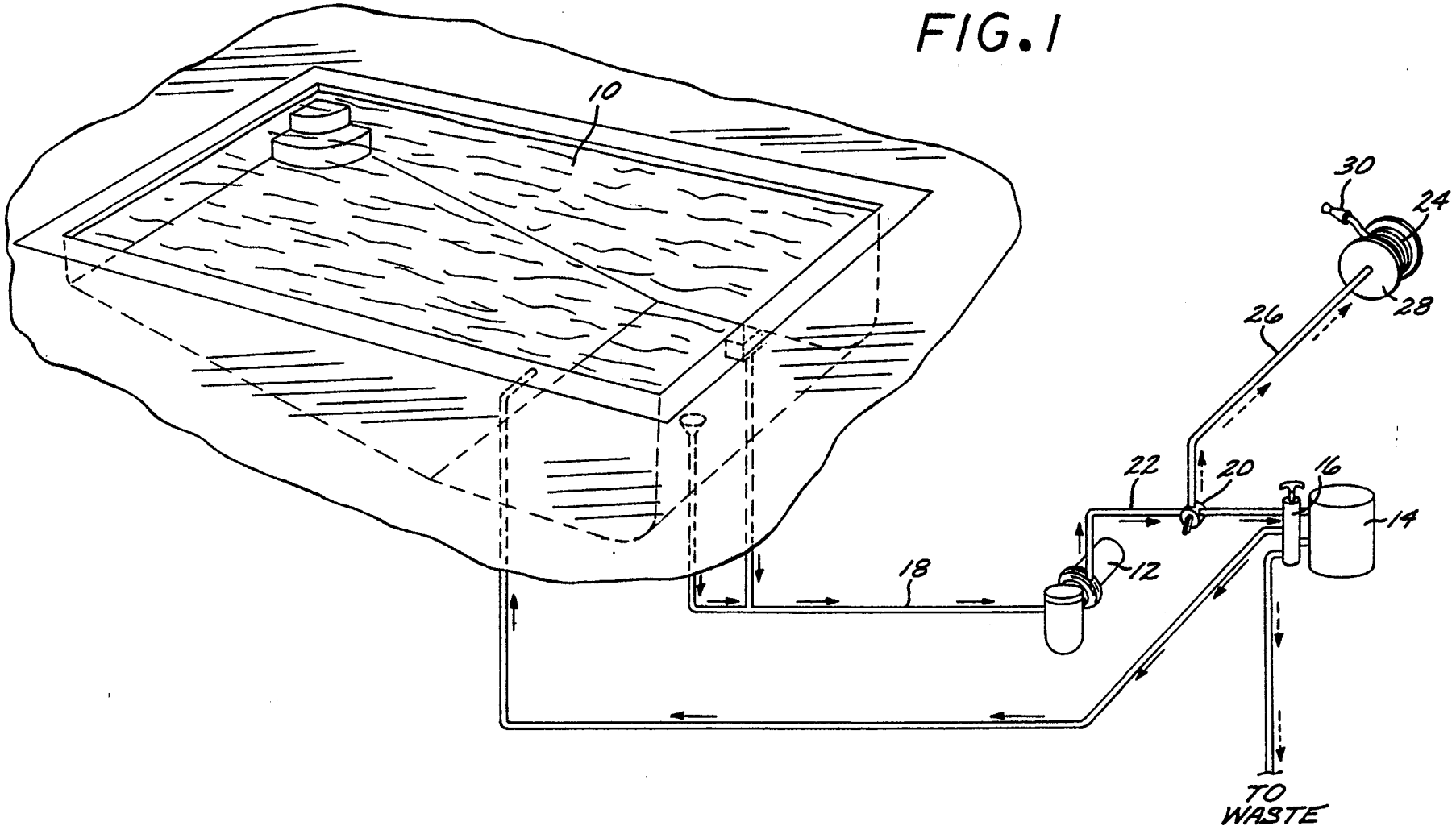
FIG. 1 is a schematic perspective view of the fire fighting equipment of the present invention, as such equipment is integrated with a swimming pool and associated pump and filter.

Referring now to the drawing figures, and particularly to the schematic view of FIG. 1, the basic components, structure, and principle of operation of the present invention, as embodied in the first preferred embodiment, is disclosed. It should be noted at the outset, that the present invention is integrated with a swimming pool or spa and associated pumping and filtering equipment which is conventionally used for circulating and filtering the water in the swimming pool or spa. The structure and operation of these conventional components and equipment is described here only to the extent necessary to explain the present invention.

Thus, there is shown on FIG. 1 a conventional swimming pool 10, a pump 12, a filter 14, and a back-wash valve 16 connected with the filter 14. As it is known in the art, a swimming pool such as the one schematically shown on FIG. 1 (and to a somewhat lesser extent even a spa) contains many thousand gallons of water and is therefore a good source of water for fighting a fire in an emergency, particularly in situations where alternative or better supply of water is not readily available. As is shown on FIG. 1, a pipe 18 connects the swimming pool 10 with the pump 12 to drain water from the pool 10 usually at two places or more, specifically on the bottom of the pool and from the water's surface, as is shown particularly in FIG. 1. The pump 12 used in connection with swimming pools and spas of the type normally associated with homes is normally driven by a motor of at least 1.5 HP, and the pump is usually capable of pumping water with a pressure greater than 40 PSI, usually in the 40 to 200 PSI range. The polyvinyl chloride (PVC) pipe normally utilized in connection with swimming pools and spas associated with homes usually has a burst capacity of approximately 330 PSI. It is a feature of the present invention that the fire fighting equipment of the invention is designed to function with the swimming pool and related water circulating equipment which is already in existence, and in some cases, already installed in homes and the like.

Continuing with the brief description of the swimming pool and associated water circulating equipment schematically shown on FIG. 1, water from the pump 12 enters, through the backwash-valve 16, into the filter 14, from where it returns, again through the backwash valve 16, to the swimming pool 10. As is known, the flow of water through the filter 14 can be reversed by actuation of the backwash valve 16, in which case the water carrying off filter particles and accumulated dirt is discharged as waste.

In accordance with the present invention a three-way valve 20 is incorporated into the pipe 22 which connects the pump 12 with the filter 14, more specifically with the backwash valve 16. Unless it is desired to use the fire fighting equipment of the present invention, the three-way valve 20 is set so that water continues to flow from the pump 12 to the backwash valve 16 and filter 14. A conventional fire hose 24 is fluidly connected to the three-way valve 20 through the intermediacy of additional pipe 26. When it is desired to utilize the fire fighting equipment of the present invention, then the three-way valve 20 is turned into a position where a substantial portion of the flow is directed to the fire hose 24. In the herein described preferred embodiments the fire hose 24 is approximately 100 feet long, has approximately 1½ inch diameter, typically has a burst capacity of approximately 400 PSI, and is not collapsible. As is usual in the art, the fire hose 24 is stored wound on a drum or winch 28 or rack on which the hose is hung or folded. A standard "fogger" type fire fighting nozzle 30, such as the PR Inc. model 2960 nozzle, is attached to the end of the fire hose 24. It should already be apparent from the foregoing description and inspection of the drawing figures, that when the three-way valve 20 is turned so as to direct the flow of water towards the fire hose 24, then water, under pressure of the pump 12, becomes available to fight a fire (or for any other desired use) without reliance on any water source other than the swimming pool or spa 10. As noted above, pumps normally associated with swimming pools or spas usually have water output in the pressure range of 40 to 200 PSI, with 55 PSI being typical. Approximately 60 gallons per minute water flow output of the pump 12 is also typical. Accordingly, approximately this amount of water, and specifically a slightly lesser amount for the reasons described in detail below, is available to fight a fire in accordance with the present invention.

Referring now specifically to the three-way valve 20, in the herein described preferred embodiment this valve is constructed substantially in accordance with the teachings of U.S. Pat. No. 4,601,307, the specification of which is incorporated herein by reference. Such a valve is commercially available, and is commonly known as a "Jandy" valve. A significant improvement to this valve is that it is equipped with a mechanical stop feature so that the flow of water through the valve from the pump 12 into the filter 14 is not blocked off completely even when the valve 20 is set to supply the predominant portion of the water flow to the fire hose 24. In the preferred embodiment the mechanical stop allows a continued flow with approximately 10 PSI pressure through the filter 14 at all times. This feature is advantageous, because in the event there were an obstruction of the flow in the fire hose 24, or if the flow were closed completely by closure in the nozzle 30, then, in the absence of the back stop feature unduly large pressure or heat would build in the system which could damage the pump 12, associated pipes or other components of the system. Thus, the back stop feature acts as means for pressure relief in the system.

Figure 2:
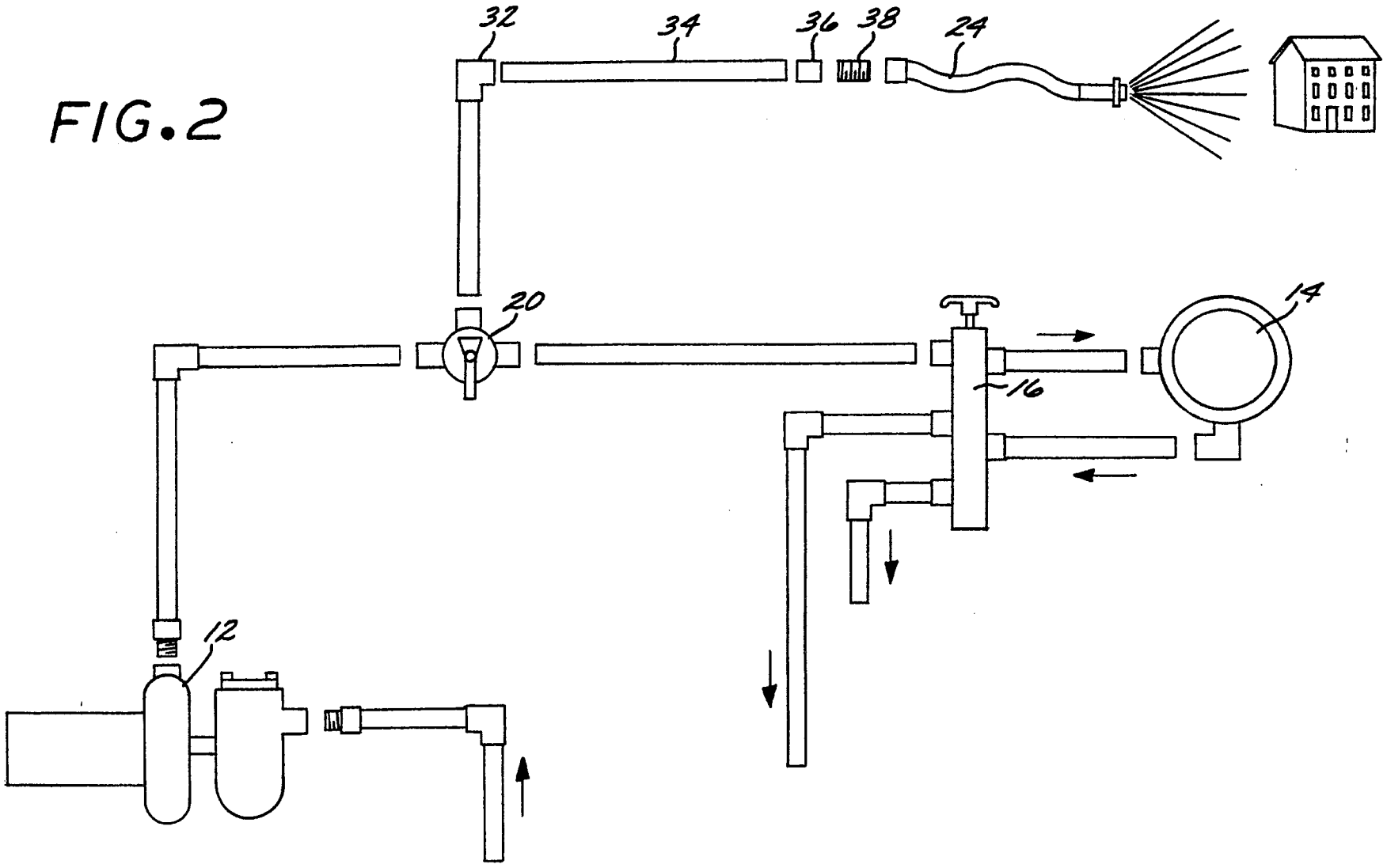
FIG. 2 is a schematic plan view of a first preferred embodiment of the present invention.

Referring now primarily to FIG. 2 of the appended drawings, it is noted that essential components of the present invention may advantageously be provided in a "kit" form, thus enabling a person to either install the fire fighting equipment of the invention when a swimming pool or spa is originally installed, or to relatively easily "retrofit" the swimming pool equipment with the fire fighting equipment of the present invention. FIG. 2 thus shows the "Jandy" valve 20, which is normally connected to the usual 1½" schedule 40 PVC pipe of most swimming pool installations with such slip-on couplings which are well known in the art. FIG. 2 shows a conventional elbow coupling 32 attached to standard PVC pipe sections 34, a threaded female National Pipe Thread fitting 36, and a National Standard Thread connector 38, to which the fire hose 24 having a standard NST connection is attached. It will be readily appreciated by those skilled in the art in light of the foregoing disclosure that a "kit" containing the "Jandy" valve 20, a number of slip on couplings for PVC pipe, the fitting 36, the connector 38, the fire hose 24 possibly including the winch or drum or storage device 28, and nozzle 30, enables installation or retrofit of the fire fighting equipment of the present invention to a swimming pool or spa. The standard PVC pipe sections 34, elbow coupling 32 and other PVC parts mentioned above can be affixed to one another with glue of the type which is well known in the art pertaining to PVC pipe.

Figure 3:
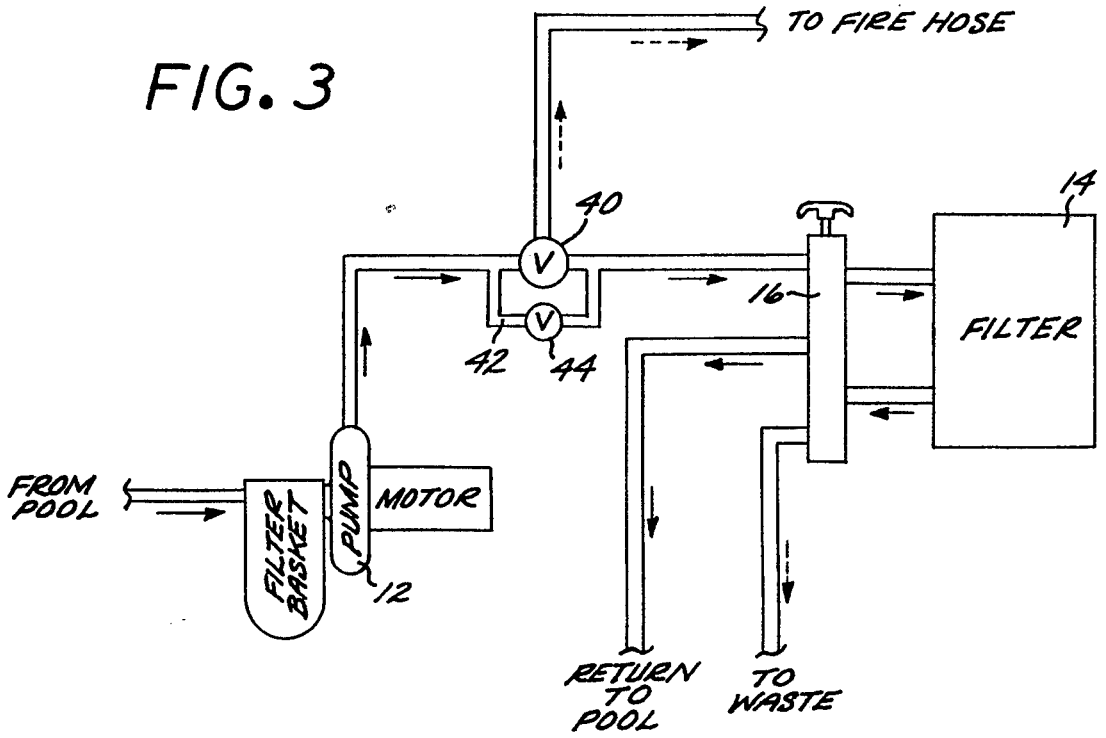
FIG. 3 is a schematic plan view of a second preferred embodiment of the present invention.

Referring now to FIG. 3 of the appended drawings, a second preferred embodiment of the fire fighting equipment of the present invention is shown integrated with a conventional swimming pool and swimming pool water circulating system. The second preferred embodiment includes a three-way valve 40, which however is not a "Jandy" valve, and does not have a mechanical stop to provide relief against excessive water pressure in the event the flow in the fire hose 24 or nozzle 30 is restricted. Instead, a parallel line 42 incorporates a pressure relief valve 44, which opens and allows water flow toward the filter 14 if the flow through the fire hose 24 is overly restricted.

Figure 4:
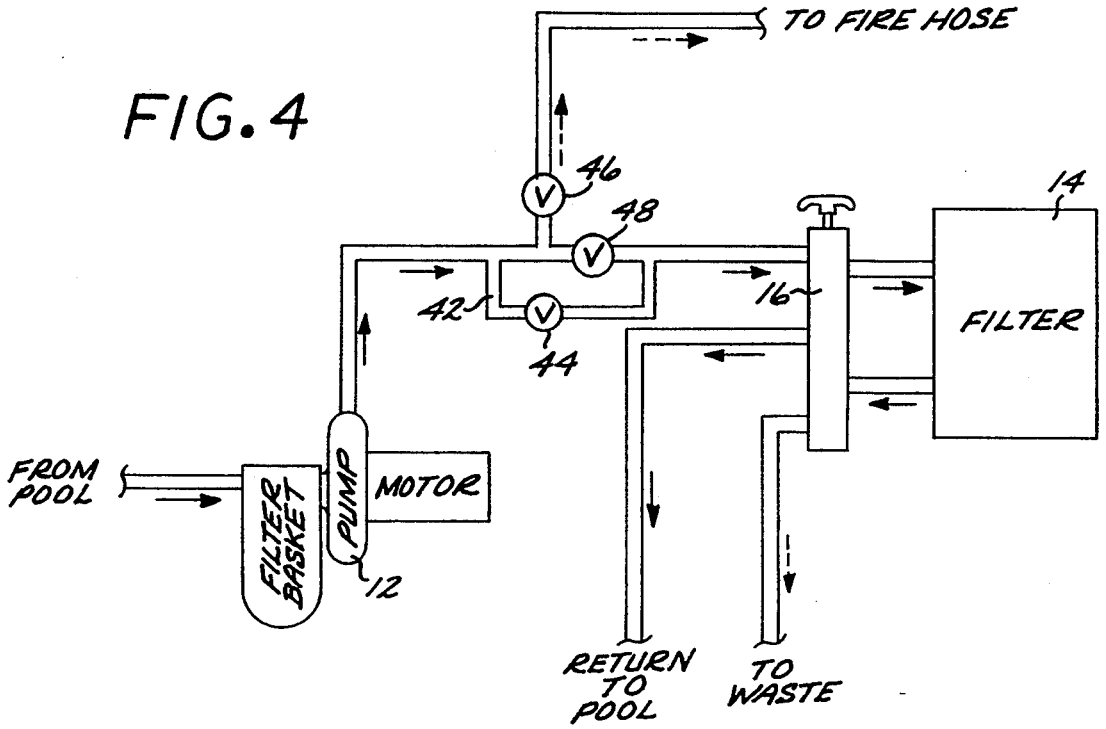
FIG. 4 is a schematic plan view of a third preferred embodiment of the present invention.

FIG. 4 schematically shows a third preferred embodiment. In this embodiment two regular "two-way" valves 46 and 48 placed respectively on the lines leading to the fire hose 24 and the filter 14 provide the ability for an operator to manually open the flow to the fire hose 24 and completely or partially shut off the flow to the filter 14. In order to avoid the possibility of excessive pressure build up and damage in the event the flow in the fire hose 24 or nozzle 30 is restricted, the operator merely needs to make sure that the flow toward the filter is not completely closed off by valve 48. Nevertheless, as an additional safety feature, a pressure relief valve 44 may also be provided on a parallel line 42.

The advantages of the above-described invention should be readily apparent to those skilled in the art in light of the foregoing disclosure. In an actual embodiment of the invention, using a 1½ HP pump of a typical swimming pool installation, generating pressures of approximately 35 to 40 PSI at a water volume of approximately 55 gallons/minute, using a modified "Jandy" valve of the first preferred embodiment, a 70 foot long stream of water was produced at the end of a standard 100 foot long, 1½" diameter fire hose. This same flow was sufficient to produce a fan of water with the nozzle in the "fogger" position, which was approximately twenty-five feet in width and height.

Figure 5:
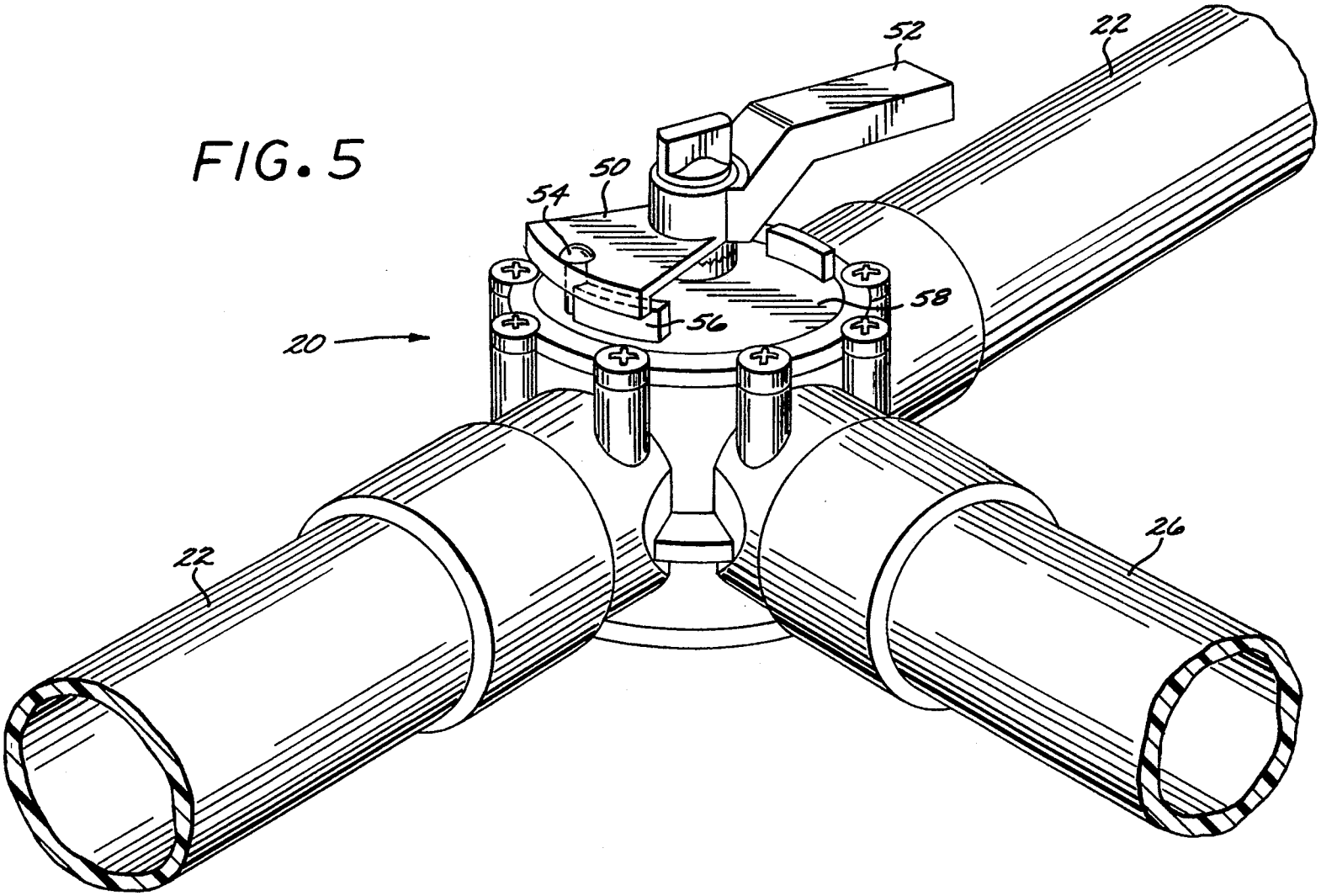
FIG. 5 is a perspective view of the three way valve used in the first preferred embodiment of the present invention

Fig. 5 is a detailed perspective view of the "Jandy" valve 20 used in the herein described first preferred embodiment of the present invention. The commercially available valve of U.S. Pat. No. 4,601,307 is modified only in the sense that a hole is provided in a flange 50 which is rigidly connected to the handle 52 of the valve 20. A pin or preferably a screw 54 is placed in the hole, to protrude below the upper surface of the flange 50. The pin or screw 54 engages a projection 56 incorporated in the valve housing 58 so as to prevent the handle 52 to be turned in a position where flow of water through the valve 20 into the pool filter 14 would be entirely cut-off.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. Equipment for providing water for use in fire emergency in combination with a building, a reservoir for water which is maintained in association with the building, conduits for water which permit circulation of the water of the reservoir through a filter, and a pump in operative association with the conduits for circulating the water through the filter, the water being circulated through the filter by the pump during normal use of the pump and filter when there is no fire emergency, the equipment comprising:

a fire hose, and valve means operatively connected with the conduits for normally allowing circulation of the entire water output of the pump through the filter and back into the reservoir during normal use of the pump and for optionally diverting a substantial amount of the water output of the pump into the fire hose for emergency use, the fire hose being fluidly connected to the valve means.

2. The invention of claim 1 where the reservoir for water is a swimming pool.

3. The invention of claim 1 further comprising a nozzle connected to one end of the fire hose, the other end of the fire hose being fluidly connected to the valve means.

4. The invention of claim 1 wherein the building is a home.

5. The invention of claim 1 wherein the valve means is adapted for optionally diverting into the fire hose approximately 90 per cent of the water output of the pump.

6. The invention of claim 1 wherein the pump has an output of water at a pressure which is at least 40 PSI.

7. In an installation of a swimming pool or spa in association with a building, the installation including said swiping pool or spa serving as an available supply of water, a filter through which the water is normally filtered in connection with the regular maintenance of the swimming pool or spa, conduit means for water which permit circulation of the water through the filter and back into the swimming pool or spa, and a pump in operative association with the conduit means for normally pumping the water through the filter, the conduit means including a pipe connecting the pump with the filter, the improvement comprising:

a fire hose, and valve means fluidly connected to the conduit means for normally allowing the entire output of the pump to flow into the filter from where it returns to the swimming pool or spa, the valve means also being adapted for optionally diverting a substantial portion of the water output of the pump to the fire hose, one end of which is fluidly connected to the valve means, whereby the diverted water is available for fighting a fire.

8. The improvement of claim 7 further comprising a nozzle fluidly connected to the second end of the fire hose.

9. The improvement of claim 8 wherein the pump has an output of water at a pressure which is at least 35 PSI.

10. The improvement of claim 7 wherein the valve means comprise a three way valve.

11. The improvement of claim 10 wherein the three way valve includes stop means for making it impossible to totally shut off flow of water from the pump to the filter.

12. A kit designed for incorporation to an existing installation of swimming pool or spa installed in association with a building, said swimming pool or spa serving as an available supply of water, and having a filter through which the water is normally filtered in connection with the regular maintenance of the swimming pool or spa, conduit means for water which permit circulation of the water through the filter and back into the swimming pool or spa, and a pump in operative association with the conduit means for normally pumping the water through the filter, the conduit means including a pipe connecting the pump with the filter, the kit including:

a three-way valve;

a plurality of slip-on couplings for connecting pipes;

a non-collapsible fire hose, and a nozzle, the three-way valve being adapted to be installed with the aid of the couplings on the pipe connecting the pump with the filter, one end of the fire hose capable of being fluidly connected to the three-way valve, and the other end of the fire hose capable of being fluidly connected to the nozzle, the three-way valve capable of normally allowing the entire output of the pump to flow into the filter from where it returns to the swimming pool or spa, the three-way valve also being capable of optionally diverting a substantial portion of the water output of the pump to the fire hose, whereby when the kit is incorporated and the 3-way valve is used to divert water to the fire hose, the diverted water is available for fighting a fire.

13. The kit of claim 12 wherein the couplings are made of plastic material and the pipe connecting the pump with the filter is made of plastic material.

14. The kit of claim 12 further comprising glue for gluing the couplings and the pipe to one another.

15. The kit of claim 12 wherein the three-way valve includes stop means for making it impossible to totally shut off flow of water from the pump to the filter.

* * * * *